United States Patent [19]

Cooper et al.

[11] 3,935,376

[45] Jan. 27, 1976

[54] CERAMIC INSULATOR FOR SUPPORTING A RIBBON-TYPE HEATING ELEMENT

[75] Inventors: Leland L. Cooper, Cabbot; Darl L. Beer, Sarver, both of Pa.

[73] Assignee: Du-Co Ceramics Company, Saxonburg, Pa.

[22] Filed: Dec. 18, 1974

[21] Appl. No.: 533,810

[52] U.S. Cl. ..... 174/138 J; 219/532; 219/542; 219/548; 338/279; 338/290; 338/317; D26/10

[51] Int. Cl.[2].. H01B 17/56; H05B 3/02; H05B 3/32

[58] Field of Search..... 174/138 J, 152 G, 167, 174/174, 175, 212; 13/25; 219/355, 532, 536, 537, 542, 546, 548; 338/58, 278–283, 290, 305, 315–318, 321; D26/10

[56] References Cited

UNITED STATES PATENTS

| | | | |
|---|---|---|---|
| 1,489,843 | 4/1924 | MacInnes | 338/317 X |
| 1,715,690 | 6/1929 | Ziola | 219/532 |
| 1,853,382 | 4/1932 | Smalley | 174/138 J X |
| 2,162,341 | 6/1939 | Adam | 219/542 X |

FOREIGN PATENTS OR APPLICATIONS

| | | | |
|---|---|---|---|
| 784,992 | 5/1935 | France | 219/532 |

*Primary Examiner*—Laramie E. Askin
*Attorney, Agent, or Firm*—Webb, Burden, Robinson & Webb

[57] ABSTRACT

A ceramic insulator having sidewalls, a front wall and a back wall with an outwardly extending mounting shoulder at the upper end of the front and back walls; a passageway extending between the sidewalls of the insulator to form an open interior portion within the insulator which receives a ribbon heating element and a slot in the front wall connecting with the open interior portion of the insulator for insertion of a ribbon heating element into the open interior portion; a bearing surface within the open interior portion to support a ribbon heating element; and an elongated radiused rib extending outwardly from each sidewall below the bearing surface to provide curved contact surfaces for a ribbon heating element.

3 Claims, 3 Drawing Figures

CERAMIC INSULATOR FOR SUPPORTING A RIBBON-TYPE HEATING ELEMENT

Our invention relates generally to high temperature, electrical insulators and, more particularly, to ceramic insulator supports suitable for use in ribbon-type electrical resistance heaters.

Generally, electrical resistance heaters employ either coiled wire heating elements or ribbon type heating elements. Both types of heating elements naturally expand during heating and contract when the current is shut off. The coil type heating elements compensate for this expansion and contraction due to their spring-like configuration. The ribbon heating elements of the type to which our invention is directed, on the other hand, must be strung in the cold state under tension so as to avoid undue sagging caused by thermal expansion during heating. The ribbon heating element is strung under tension on laterally opposed insulator supports or hooks across the face of the heater. Due to the high operating temperature and high electrical current present in the heaters, ceramic has generally been employed as an insulator support material. Ceramics such as unglazed steatite are generally employed since they exhibit good thermal, electrical and mechanical strength properties at a relatively low cost. The insulators of the prior art do, however, present problems due to the inherent abrasiveness of the ceramic employed and the physical configuration of the insulator used. These prior insulators generally possess sharp edges which tightly bear against the ribbon heating element when it is tensionally strung thereon. We have found that these prior insulator hooks have caused ribbon breakage problems due to the abrasive wear resulting from the sharp edges of the insulator acting on the ribbon as it expands and contracts during operation.

Our invention solves the ribbon breakage problems heretofore encountered by providing an economical, unglazed ceramic insulator which minimizes abrasive wear of the ribbon element. Our invention also provides an insulator body which has improved strength properties in both the unfired and fired conditions resulting from the outwardly extending radiused ribs thereon. The radiused support ribs, likewise, minimize objectionable warpage of the insulator body during the firing operation.

Briefly, our invention provides a ceramic insulator body, preferably of steatite, which includes shoulder means outwardly extending therefrom for mounting the insulator within the heater. The insulator body has opposed, generally parallel sidewalls and an open interior portion extending between the sidewalls and communicating with a slot to permit the insertion of the ribbon element within the open portion. A bearing surface, preferably flat, extends within the interior portion terminating adjacent the side walls. A pair of radiused, support ribs each outwardly extend from an opposed side wall adjacent the bearing surface and generally offset downwardly and parallel thereto. In use, the ribbon heating element is strung through the open interior of the insulator body and is supported under tension on the bearing surface and the radiused ribs. The outwardly extending radiused ribs supportingly engage the ribbon element and present a smooth, curved surface upon which the ribbon may rest. The smoothly curved, radiused ribs thus minimize abrasive wear to the ribbon during thermal expansion and contraction thereof.

For a better understanding of the invention, reference is made to the drawings and the following detailed description.

Figure 1:
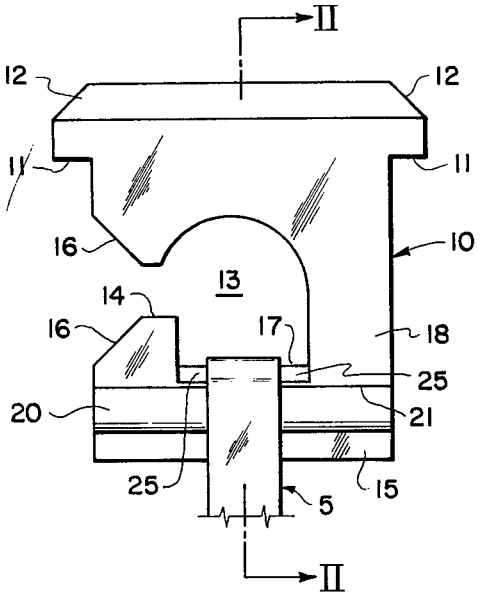
FIG. 1 is a side elevation of one presently preferred embodiment of the insulator of this invention showing the ribbon heating element positioned thereon.

Referring now to the specific details of the drawings, one presently preferred embodiment of the insulator and support element of this invention is designated generally by the numeral 10. Insulator 10 is constructed of a heat resistant material having good dielectric properties, preferably a steatite ceramic. Insulator 10 is generally rectangular in shape including a pair of spaced apart, opposed sidewalls 18 generally parallel to each other, a front wall and a back wall. Insulator body 10 is adapted to be mounted in a ribbon type resistance heater and, therefore, includes mounting shoulders 11 outwardly projecting from the upper end of the front and back walls. Shoulders 11 are adapted to be received within a mounting channel of the heater (not shown). In order to facilitate the mounting of insulator 10 within the heater, each shoulder 11 may also include an inwardly sloping tapered portion 12. Tapered portions 12 provide a lead to assist in the insertion of insulator 10 within the mounting channels of the heater, however, they are not absolutely necessary since a straight shoulder is also operable.

A passageway through insulator body 10 forms an open interior portion 13 extending between opposed sidewalls 18. A slot 14 is formed in body 10 and communicates with open interior portion 13 to permit the insertion of ribbon heating element 5 therein. Slot 14 may also be provided with tapered portions 16 flaring outwardly therefrom to facilitate the insertion of ribbon 5 therethrough.

A flat bearing surface 17 is located within open interior portion 13 and forms the bottom of the passageway through insulator body 10. A longitudinally extending, radiused rib 20 extends outwardly from each sidewall 18 adjacent bearing surface 17. The longitudinal axes of radiused support ribs 20 are parallel to and offset downwardly from the plane defined by flat bearing surface 17. In this regard, it can be seen in FIGS. 1 and 3 that the line 21 defined by the intersection of radiused rib 20 and sidewall 18 is also parallel to the plane of bearing surface 17. As can be seen in FIG. 2, support ribs 20 outwardly extend from sidewalls 18 a distance substantially equal to their full radius of curvature.

The upper edges 21 of support ribs 20 may be flush with bearing surface 17, however, in order to increase the strength it is preferable to increase the thickness of the insulator body in its bottom section at 15. In this regard, we have found it advantageous to utilize beveled surfaces 25 which taper downwardly and outwardly from opposite edges of bearing surface 17 to sidewalls 18 immediately above support ribs 20. Bevels 25 permit a thicker cross section at 15, as shown in FIG. 2, and provide greater strength for the unfired pressed pieces and further minimize warpage during bulk firing. We have, likewise, found that by extending radiused ribs 20 the full width of insulator 10 along sidewalls 18, the strength in both the unfired and fired body is enhanced and further the tendency to warp during firing is minimized.

Figure 2:
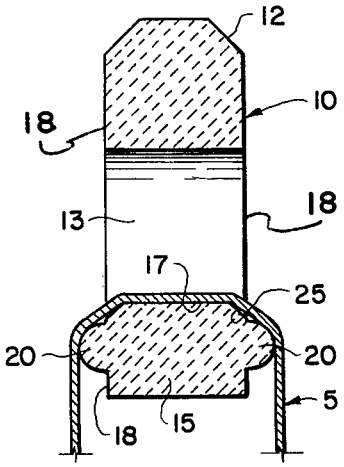
FIG. 2 is a sectional view taken along line II—II of FIG. 1.
Figure 3:
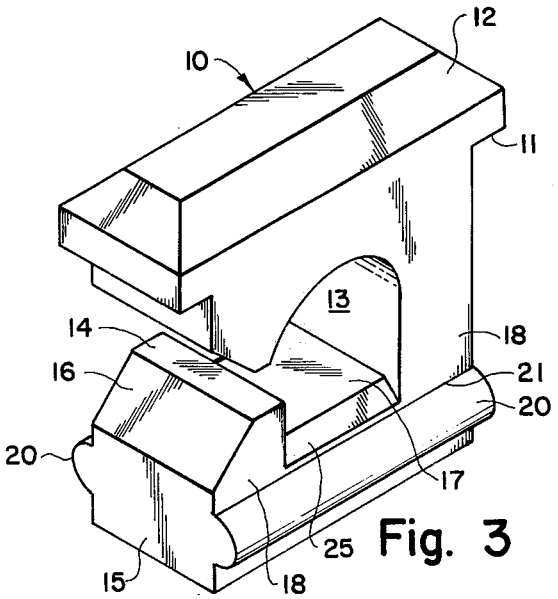
FIG. 3 is a perspective view of the insulator of FIGS. 1 and 2.

FIG. 1 and 2 show the ribbon heating element 5 as it would appear when mounted within insulator 10. In FIG. 1 it can be seen that the width of flat bearing surface 17 is greater than the width of ribbon element 5. Likewise, longitudinally extending support ribs 20 are parallel in relation to flat bearing surface 17 throughout its width. This feature permits movement of ribbon element 5 across the width of bearing surface 17 during ribbon assembly and thus permits slight variation in tolerances and misalignment within the heater. Even though slight misalignment may be present, the ribbon element 5 at all times rests against flat bearing surface 17 and against parallel ribs 20 to maintain alignment. Thus, the ribbon element 5 will not be pinched or crimped as is sometimes the case in prior insulator hooks.

As can be seen in FIG. 2, outwardly extending support ribs 20 present a smoothly curved, radiused surface upon which ribbon element 5 is supported. Due to the fact that radiused ribs 20 extend outwardly from sidewalls 18 a distance at least as great as their full radius, they bearingly support ribbon 5 along a substantial surface thereof and as such support most of the tensional forces within ribbon 5. The radiused ribs 20 possess a smooth and fully radiused surface which presents no sharp edge contact with ribbon element 5 and, therefore, minimize the abrasive wear resulting from the expansion and contraction of ribbon element 5 during operation.

We have thus found that the radiused ribs 20 minimize the wear problems encountered in the past and permit the manufacturer of ceramic insulators to utilize an economical, unglazed steatite ceramic body eliminating the necessity of an expensive secondary glazing operation. In addition to minimizing the abrasive wear on the ribbon element, ribs 20 also increase the strength of the unfired, pressed piece and the strength and stability of the fired piece.

What is claimed is:

1. A ceramic insulator for supporting a ribbon heating element within an electric resistance heater; said insulator having spaced sidewalls, a front wall and a back wall; a pair of mounting shoulders located at the upper end of said insulator for supporting said insulator in a heater, one of said mounting shoulders extending outwardly from the front wall of said insulator and the other of said mounting shoulders extending outwardly from the back wall of said insulator; a passageway extending through said insulator between said spaced sidewalls to form an open interior portion within said insulator adapted to receive a ribbon heating element; said front wall of said insulator having a substantially horizontally extending slot formed therein connecting with said open interior portion of said insulator to provide access to said open interior portion for insertion of a ribbon heating element into said open interior portion; a flat bearing surface located between said spaced sidewalls and forming the bottom of said passageway, said bearing surface located in a plane below a plane including the bottom of said slot, said bearing surface adapted to support a ribbon heating element extending through said open interior portion of said insulator; each of said spaced sidewalls having an elongated radiused rib extending outwardly therefrom, the longitudinal axis of each of said ribs being parallel to and located below said plane including said bearing surface, each of said ribs extending along one of said spaced sidewalls from said front wall to said back wall of said insulator, the curved surface of each of said ribs providing a rounded contact surface located below said plane including said bearing surface, whereby a ribbon heating element extending through said open interior portion of said insulator and supported by said bearing surface contacts a portion of said rounded surface of each of said ribs to minimize abrasive wear between said insulator and the ribbon heating element during expansion and contraction of the ribbon heating element.

2. An insulator as set forth in claim 1 including a beveled surface extending downwardly and outwardly from each side edge of said flat bearing surface to the adjacent sidewall at the upper edge of the rib extending along said sidewall.

3. An insulator as set forth in claim 1 including outwardly flaring tapered portions at the horizontal edges of said slot located at said front wall, whereby said slot is larger at said front wall of said insulator than at the junction with said open interior portion of said insulator to facilitate insertion of a ribbon heating element into said open interior portion of said insulator.

* * * * *